US009783926B2

(12) United States Patent
Irnich et al.

(10) Patent No.: US 9,783,926 B2
(45) Date of Patent: Oct. 10, 2017

(54) PROCESS FOR THE COATING OF TEXTILES

(71) Applicant: Bayer Intellectual Property GmbH, Monheim am Rhein (DE)

(72) Inventors: Rolf Irnich, Shanghai (CN); Zhao Xuehui, Shanghai (CN)

(73) Assignee: Covestro Deutschland AG, Leverkusen (DE)

( * ) Notice: Subject to any disclaimer, the term of this patent is extended or adjusted under 35 U.S.C. 154(b) by 685 days.

(21) Appl. No.: 14/355,087

(22) PCT Filed: Oct. 16, 2012

(86) PCT No.: PCT/EP2012/070480
§ 371 (c)(1),
(2) Date: Apr. 29, 2014

(87) PCT Pub. No.: WO2013/057099
PCT Pub. Date: Apr. 25, 2013

(65) Prior Publication Data

US 2014/0302734 A1 Oct. 9, 2014

(30) Foreign Application Priority Data

Oct. 18, 2011 (WO) ..... PCT/CN2011/001733

(51) Int. Cl.

| | |
|---|---|
| ***C08J 7/04*** | (2006.01) |
| ***B32B 5/30*** | (2006.01) |
| ***D06N 3/00*** | (2006.01) |
| ***D06M 15/05*** | (2006.01) |
| ***D06M 15/09*** | (2006.01) |
| ***D06M 15/564*** | (2006.01) |
| ***D06N 3/02*** | (2006.01) |
| ***D06N 3/04*** | (2006.01) |
| ***D06N 3/10*** | (2006.01) |
| ***D06N 3/14*** | (2006.01) |
| ***D06N 3/18*** | (2006.01) |
| ***D06M 13/285*** | (2006.01) |
| ***D06M 13/46*** | (2006.01) |
| ***D06M 13/463*** | (2006.01) |
| ***D06M 15/227*** | (2006.01) |
| ***D06M 15/263*** | (2006.01) |

(52) U.S. Cl.

CPC ..... *D06N 3/0088* (2013.01); *D06M 13/285* (2013.01); *D06M 13/46* (2013.01); *D06M 13/463* (2013.01); *D06M 15/05* (2013.01); *D06M 15/09* (2013.01); *D06M 15/227* (2013.01); *D06M 15/263* (2013.01); *D06M 15/564* (2013.01); *D06N 3/0043* (2013.01); *D06N 3/02* (2013.01); *D06N 3/042* (2013.01); *D06N 3/10* (2013.01); *D06N 3/14* (2013.01); *D06N 3/183* (2013.01); *D06N 3/186* (2013.01); *D06N 2205/24* (2013.01); *D06N 2205/243* (2013.01); *D06N 2211/28* (2013.01); *Y10T 442/2098* (2015.04)

(58) Field of Classification Search

CPC ..... C08J 7/042; C08J 7/045; B32B 5/30
USPC ..... 427/299, 301, 324; 442/70, 71
See application file for complete search history.

(56) References Cited

U.S. PATENT DOCUMENTS

| | | | | |
|---|---|---|---|---|
| 3,684,759 | A | 8/1972 | Reiff et al. | |
| 4,918,129 | A | 4/1990 | Probst et al. | |
| 5,391,664 | A * | 2/1995 | Takei | C08F 4/32 526/210 |
| 5,518,764 | A | 5/1996 | Träubel et al. | |
| 5,916,636 | A | 6/1999 | Vogt | |
| 5,952,413 | A | 9/1999 | Vogt | |
| 5,968,597 | A | 10/1999 | Vogt et al. | |
| 6,040,393 | A | 3/2000 | Vogt et al. | |
| 2004/0034162 | A1 | 2/2004 | Laas et al. | |
| 2004/0121113 | A1 * | 6/2004 | Mobley | D06N 3/0052 428/85 |
| 2009/0311929 | A1 * | 12/2009 | Schuette | D06N 3/14 442/59 |
| 2013/0005206 | A1 | 1/2013 | Krings et al. | |

FOREIGN PATENT DOCUMENTS

| | | |
|---|---|---|
| CA | 1061043 A1 | 8/1979 |
| CA | 2253119 A1 | 5/1999 |

(Continued)

OTHER PUBLICATIONS

JP 48028043 translation Aug. 29, 1973 retrieved from USPTO translation office.*

(Continued)

*Primary Examiner* — Cachet Sellman
(74) *Attorney, Agent, or Firm* — Drinker Biddle & Reath LLP

(57) ABSTRACT

A process for the production of coated textiles comprises at least the steps of a) bringing a textile substrate into contact with an aqueous dispersion A comprising at least one salt and at least one modified cellulose, b) bringing a textile substrate into contact with an aqueous dispersion B comprising at least one polymer selected from the group consisting of polyurethane, polyacrylate and polybutadiene and c) precipitation of the polyurethane in or on the textile substrate. The salt of dispersion A is an organic onium salt of one or more elements of the fifth main group of the periodic table of the elements. The invention further relates to a coated textile obtainable by a process according to the invention and to the use of organic onium salts of one or more elements of the fifth main group of the periodic table of the elements for the production of coated textiles.

10 Claims, No Drawings

(56) References Cited

FOREIGN PATENT DOCUMENTS

| | | | | |
|---|---|---|---|---|
| DE | 1953349 | A1 | | 4/1971 |
| DE | 2446440 | A1 | | 4/1976 |
| DE | 3806066 | A1 | | 9/1989 |
| DE | 102010011067 | A1 | | 9/2011 |
| EP | 0916647 | A2 | | 5/1999 |
| JP | 48028043 | B | * | 8/1973 |
| JP | 48028043 | B | | 8/1973 |
| WO | WO-0188006 | A1 | | 11/2001 |
| WO | WO-2011138284 | A1 | | 11/2011 |

OTHER PUBLICATIONS

International Search Report for PCT/EP2012/070480 mailed Mar. 20, 2013.

* cited by examiner

PROCESS FOR THE COATING OF TEXTILES

CROSS-REFERENCE TO RELATED APPLICATIONS

This application is a national stage application (under 35 U.S.C. §371) of PCT/EP2012/070480, filed Oct. 16, 2012, which claims benefit of Chinese Application No. PCT/CN2011/001733, filed Oct. 18, 2011, both of which are incorporated herein by reference in their entirely.

The present invention relates to a process for the production of coated textiles in which a textile substrate is firstly brought into contact with an aqueous dispersion comprising at least one salt and at least one modified cellulose. The invention further relates to a coated textile obtainable by a process according to the invention and to the use of organic onium salts for the production of coated textiles.

The production of synthetic leather by coating textiles with plastics has been known for some time. Synthetic leathers are employed, inter alia, as shoe upper materials, for articles of clothing, as bag-making material or in the upholstery sector, for example. Besides other plastics, such as PVC, the main coating material used here is polyurethane. The generally known principles of coating textiles with polyurethane are described in W. Schröer, Textilveredlung [Textile Finishing] 1987, 22 (12), 459-467. A description of the coagulation process is additionally found in "New Materials Permeable to Water Vapor", Harro Träubel, Springer Verlag, Berlin, Heidelberg, New York, 1999, ISBN 3-540-64946-8, pages 42 to 63.

The main processes used in the production of synthetic leather are the direct coating process, the transfer coating process (indirect coating) and the coagulation (wet) process. In contrast to the direct process, the coating in the transfer process is applied to a temporary support with a subsequent lamination step, in which the film is combined with the textile substrate and detached from the temporary support (release paper). The transfer process is preferably employed with textile substrates, which do not permit high tensile stresses during coating, or with open fabrics which are not particularly dense.

In the coagulation process, a textile substrate is usually coated with a solution comprising polyurethane in DMF. In a second step, the coated substrate is passed through DMF/water baths, where the proportion of water is increased stepwise. Precipitation of the polyurethane and formation of a microporous film occur here. Use is made here of the fact that DMF and water have excellent miscibility and DMF and water serve as a solvent/non-solvent pair for polyurethane.

Coagulated polyurethane coatings are employed, in particular, for high-quality synthetic leather, since they have comparatively good breathing activity and a leather feel. The basic principle of the coagulation process is based on the use of a suitable solvent/non-solvent pair for polyurethane. The great advantage of the coagulation process is that microporous, breathing-active synthetic leather having an excellent leather feel can be obtained. Examples are, for example, the synthetic leather brands Clarino® and Alcantara®.

A disadvantage of the coagulation process is the necessity to use large amounts of DMF as an organic solvent. In order to minimize the exposure of employees to DMF emissions during production, additional design measures have to be taken, which represent a not inconsiderable increased outlay compared with simpler processes. Furthermore, it is necessary to dispose of or work up large amounts of DMF/water mixtures. This is problematical since water and DMF form an azeotrope and can therefore only be separated by distillation with increased effort.

US 2004/121113 A1 describes a synthetic leather which is made by a impregnating a non-woven or woven textile with an aqueous polyurethane dispersion comprised of a nonionizable polyurethane and an external stabilizing surfactant. The impregnated textile is then exposed to water containing a coagulant for a coagulation time sufficient to coagulate the dispersion. The method may be used to form a synthetic leather having excellent wet ply adhesion and may contain an insoluble multivalent cation organic acid.

In processes in which a textile substrate is first contacted with an inorganic coagulant salt (such as sodium chloride or calcium nitrate) solution and then with a polyurethane dispersion or polyurethane paste followed by coagulation of the polyurethane, a pollution of the polyurethane dispersion or paste may arise because the inorganic salt shows no affinity to the fibers of the substrate. In general a further washing and drying step are necessary.

An object of the present invention was therefore to develop a process for the coating of textile substrates which still enables coated textiles having good properties, such as, for example, good feel, to be obtained without the need to employ toxicologically unacceptable solvents, such as, for example, DMF and wherein cross-contamination of the polyurethane component in subsequent steps is reduced or avoided.

This object has been achieved by a process for the production of coated textiles, comprising at least the steps of a) bringing a textile substrate into contact with an aqueous dispersion A comprising at least one salt and at least one modified cellulose, b) bringing a textile substrate into contact with an aqueous dispersion B comprising at least one polymer selected from the group consisting of polyurethane, polyacrylate and polybutadiene and c) precipitation of the polyurethane in or on the textile substrate, wherein the salt of dispersion A is an organic onium salt of one or more elements of the fifth main group of the periodic table of the elements.

In a preferred embodiment the process for the production of coated textiles comprises at least the steps of a) bringing a textile substrate into contact with an aqueous dispersion A comprising at least one salt and at least one modified cellulose, b) bringing a textile substrate into contact with an aqueous dispersion B comprising polyurethane and c) precipitation of the polyurethane in or on the textile substrate, wherein the salt of dispersion A is an organic onium salt of one or more elements of the fifth main group of the periodic table of the elements.

It has been found that the organic onium salts display an affinity to the substrate fiber to such an extent that polyurethane dispersions or pastes in subsequent coating steps will not be contaminated. Therefore these salts do not need to be removed from the substrate and additional washing and drying steps can be avoided. The affinity to the fiber may be, for example, of an electrostatic nature or by covalent bonding.

With respect to step a), the textile substrate is preferably brought into contact with the aqueous dispersion A at room temperature for a period of 2 to 4 minutes, particularly preferably 1 to 2 minutes, very particularly preferred 0.2 to 1 minute. For the purposes of the present invention, bringing into contact means partial or complete immersion, preferably complete immersion, in a dispersion or application of the dispersion by means of a hand coater, printing or spraying.

The textile substrate can preferably be built up from fibers of polyester, nylon (6 or 6,6), cotton, polyester/cotton blends, wool, ramie, spandex, glass, thermoplastic polyurethane (TPU), thermoplastic olefins (TPO) or the like. The textile substrate can be treated with dyes, colorants, pigments, UV absorbers, plasticizers, soil redeposition agents, lubricants, antioxidants, flame inhibitors, rheology agents and the like, either before coating or thereafter, but there is a preference for such additions before coating.

If a defined nonwoven fabric is impregnated with an elastomer polymer and coagulated, and a normal coloring process is subsequently carried out, a suede-like synthetic leather having good color development properties is obtained.

Examples for the modified cellulose include alkylated celluloses, hydroxyalkylated celluloses and carboxyalkylated celluloses.

With respect to step b), the polyurethane present in dispersion B is not particularly restricted as long as it is soluble or dispersible in water, the term "polyurethane" also encompassing polyurethane-polyureas. A review of polyurethane (PUR) dispersions and processes therefore can be found in Rosthauser & Nachtkamp, "Waterborne Polyurethanes, Advances in Urethane Science and Technology", Vol. 10, pages 121-162 (1987). Suitable dispersions are also described, for example, in "Kunststoffhandbuch" [Plastics Handbook], Vol. 7, 2nd Edition, Hauser, pages 24 to 26. Constituent components of dispersions B will be described in greater detail below.

With respect to step c), the manner in which the precipitation in or on the textile substrate is accomplished depends to a large extent on the chemical composition of the dispersion B used in accordance with the invention and in particular on the type of coagulant, if present. For example, the precipitation can be carried out by evaporation coagulation or by salt, acid or electrolyte coagulation.

In another example, the precipitation is achieved by an increase in temperature. For example, the textile substrate can be subjected to brief heat treatment with steam, for example at 100 to 110° C. for 1 to 10 s. This is particularly preferred if ammonium salts or organic acids are used as coagulant. If, on the other hand, the above-mentioned acid-generating chemicals are used as coagulant, the precipitation is preferably carried out as described in U.S. Pat. No. 5,916,636, U.S. Pat. No. 5,968,597, U.S. Pat. No. 5,952,413 and U.S. Pat. No. 6,040,393.

Alternatively, the coagulation is caused by dipping into a salt solution. The coagulation is preferably carried out using an inorganic salt selected from the group consisting of alkali metal salts and alkaline-earth metal salts. The inorganic salt is particularly preferably a salt selected from the group consisting of alkali metal halides, alkali metal nitrates, alkali metal phosphates, alkali metal sulfates, alkali metal carbonates, alkali metal hydrogen carbonates, alkaline-earth metal halides, alkaline-earth metal phosphates, alkaline-earth metal nitrates, alkaline-earth metal sulfates, alkaline-earth metal carbonates and alkaline-earth metal hydrogen carbonates. The inorganic salt is very particularly preferably sodium chloride, potassium chloride, sodium sulfate, sodium carbonate, potassium sulfate, potassium carbonate, sodium hydrogen carbonate, potassium hydrogen carbonate, magnesium chloride, magnesium sulfate, calcium chloride or calcium sulfate. The inorganic salt is still more preferably calcium chloride or magnesium chloride.

The inorganic salt is preferably present in the salt solution in an amount of 1 to 25% by weight, particularly preferably in an amount of 1 to 15% by weight, very particularly preferably in an amount of 1 to 10% by weight, based on the total amount of salt solution.

After the precipitation in step c), further steps, such as drying or condensation, may be carried out if necessary.

Constituent components of dispersions B used in accordance with the invention may be the following:

1) Organic di- and/or polyisocyanates, such as, for example, tetramethylene diisocyanate, hexamethylene diisocyanate (HDI), 2-methylpentamethylene diisocyanate, 2,2,4-trimethylhexamethylene diisocyanate (THDI), dodecanemethylene diisocyanate, 1,4-diisocyanatocyclohexane, 3-isocyanatomethyl-3,3,5-trimethylcyclohexyl isocyanate (isophorone diisocyanate=IPDI), 4,4'-diisocyanatodicyclohexylmethane (Desmodur® W), 4,4'-diisocyanato-3,3'-dimethyldicyclohexylmethane, 4,4'-diisocyanato-2,2-dicyclohexylpropane, 1,4-diisocyanatobenzene, 2,4- or 2,6-diisocyanatotoluene or mixtures of these isomers, 4,4'-, 2,4- or 2,2'-diisocyanatodiphenylmethane or mixtures of these isomers, 4,4-, 2,4'- or 2,2'-diisocyanato-2,2-diphenylpropane-p-xylene diisocyanate and α,α,α',α'-tetramethyl-m- or -p-xylene diisocyanate (TMXDI), and mixtures consisting of these compounds. For the purposes of modification, small amounts of trimers, urethanes, biurets, allophanates or uretdiones of the above-mentioned diisocyanates can be used. MDI, Desmodur W, HDI and/or IPDI are particularly preferred.

2) Polyhydroxyl compounds having 1 to 8, preferably 1.7 to 3.5 hydroxyl groups per molecule and an (average) molecular weight of up to 16,000 g/mol, preferably up to 4000 g/mol. Low-molecular-weight polyhydroxyl compounds defined in each case, such as, for example, ethylene glycol, 1,2-, 1,3-propylene glycol, 1,4-butanediol, 1,6-hexanediol, neopentyl glycol, trimethylolpropane, glycerol, the product of the reaction of 1 hydrazine+2 propylene glycol and oligomeric or polymeric hydroxyl compounds having molecular weights of 350 g/mol to 10,000 g/mol, preferably 840 g/mol to 3000 g/mol, can be considered.

Relatively high-molecular-weight hydroxyl compounds include hydroxypolyesters, hydroxypolyethers, hydroxypolythioethers, hydroxypolyacetates, hydroxypolycarbonates and/or hydroxypolyester amides which are known per se in polyurethane chemistry, preferably those having average molecular weights of 350 g/mol to 4000 g/mol, particularly preferably those having average molecular weights of 840 g/mol to 3000 g/mol. Hydroxypolycarbonates and/or hydroxypolyethers are particularly preferred. When they are used, coagulates having particular stability to hydrolysis can be prepared.

3a) Ionic or potentially ionic hydrophilizing agents containing an acid group and/or an acid group in salt form and at least one isocyanate-reactive group, for example an OH or $NH_2$ group. Examples are the Na salt of ethylenediamine-β-ethylsulfonic acid (AAS salt solution), dimethylolpropionic acid (DMPA), dimethylolbutyric acid, hydroxypivalic acid or adducts of 1 mol of diamine, preferably isophorone-diamine, and 1 mol of an α,β-unsaturated carboxylic acid, preferably acrylic acid.

3b) Nonionic hydrophilizing agents in the form of mono- and/or difunctional polyethylene oxide or polyethylene-propylene oxide alcohols having molecular weights of 300 g/mol to 5000 g/mol. Particular preference is given to monohydroxyl-functional ethylene oxide/propylene oxide polyethers based on n-butanol having 35 to 85% by weight of ethylene oxide units and molecular weights of 900 g/mol to 2500 g/mol. A content of at least 3% by weight, in particular at least 6% by weight, of nonionic hydrophilizing agents is preferred.

4) Blocking agents for isocyanate groups, such as, for example, oximes (acetone oxime, butanone oxime or cyclohexanone oxime), secondary amines (diisopropylamine, dicyclohexylamine), NH-acidic heterocyclic substances (3,5-dimethylpyrazole, imidazole, 1,2,4-triazole), CH-acidic esters (C1-4-alkyl malonates, acetic acid esters) or lactams (ε-caprolactam). Butanone oxime, diisopropylamine and 1,2,4-triazole are particularly preferred.

5) Polyamines as built-in chain extenders. These include, for example, the polyamines discussed under 6). The diamino-functional hydrophilizing agents discussed under 3a) are also suitable as chain extenders to be incorporated.

6) Polyamine crosslinking agents. These are preferably aliphatic or cycloaliphatic diamines, although it is also possible, if needed, to use trifunctional polyamines or polyfunctional polyamines in order to achieve specific properties. In general, it is possible to use polyamines containing additional functional groups, such as, for example, OH groups. The polyamine crosslinking agents, which are not incorporated into the polymer backbone at normal or slightly elevated ambient temperatures, for example 20° C. to 60° C., are either admixed immediately during preparation of the reactive dispersions or at a subsequent point in time. Examples of suitable aliphatic polyamines are ethylenediamine, 1,2- and 1,3-propylenediamine, 1,4-tetramethylenediamine, 1,6-hexamethylenediamine, the isomer mixture of 2,2,4- and 2,4,4-trimethylhexamethylenediamine, 2-methylpentamethylenediamine and diethylenetriamine.

Preferably the dispersion B comprises at least one coagulant besides polyurethane. A coagulant is a salt or acid, for example ammonium salts of organic acids, which causes coagulation of the polyurethane under certain conditions, such as, for example, a particular temperature. These substances include an acid-generating chemical agent, i.e. a substance which is not an acid at room temperature, but becomes an acid after warming. Certain examples of such compounds include ethylene glycol diacetate, ethylene glycol formate, diethylene glycol formate, triethyl citrate, monostearyl citrate and an organic acid ester.

The coagulant is preferably present in the composition in an amount of 1% by weight to 10% by weight, based on the solids content of dispersion B.

The polyurethane present in dispersion B is preferably an anionic and/or nonionic hydrophilized polyurethane, which is obtainable by AA) the preparation of isocyanate-functional prepolymers from AA1) organic polyisocyanates AA2) polymeric polyols having number average molecular weights of 400 g/mol to 8000 g/mol, preferably 400 g/mol to 6000 g/mol and particularly preferably 600 g/mol to 3000 g/mol, and OH functionalities of 1.5 to 6, preferably 1.8 to 3, particularly preferably 1.9 to 2.1, and AA3) optionally hydroxyl-functional compounds having molecular weights of 32 to 400 g/mol and AA4) optionally isocyanate-reactive, anionic or potentially anionic and/or optionally nonionic hydrophilizing agents, BB) subsequent reaction of all or some of the free NCO groups thereof BB1) optionally with amino-functional compounds having molecular weights of 32 to 400 g/mol and/or BB2) isocyanate-reactive, preferably amino-functional, anionic or potentially anionic hydrophilizing agents with chain extension, and dispersion of the resultant prepolymers in water before, during or after step BB), where any potentially ionic groups present are converted into the ionic form by partial or complete reaction with a neutralizer.

In order to achieve anionic hydrophilization, it is necessary to carry out AA4) and/or BB2) using hydrophilizing agents which contain at least one group which is reactive to NCO groups, such as amino, hydroxyl or thiol groups, and in addition contain $—COO^-$ or $—SO_3^-$ or $—PO_3^{2-}$ as anionic groups or fully or partially protonated acid forms thereof as potentially anionic groups.

Preferred aqueous, anionic polyurethane dispersions have a low degree of hydrophilic anionic groups, preferably 0.1 to 15 milliequivalents per 100 g of solid resin.

In order to achieve good sedimentation stability, the number average particle size of the specific polyurethane dispersions is preferably less than 750 nm, particularly preferably less than 500 nm and very particularly preferably less than 400 nm, determined by means of laser correlation spectroscopy.

The ratio of NCO groups in the compounds of component AA1) to NCO-reactive groups, such as amino, hydroxyl or thiol groups, in the compounds of components AA2) to AA4) during preparation of the NCO-functional prepolymer is 1.05 to 3.5, preferably 1.2 to 3.0, particularly preferred 1.3 to 2.5.

The amino-functional compounds in step BB) are employed in such an amount that the equivalent ratio of isocyanate-reactive amino groups in these compounds to the free isocyanate groups in the prepolymer is 40 to 150%, preferably between 50 and 125%, particularly preferably between 60 and 120%.

Suitable polyisocyanates of component AA1) are the aromatic, araliphatic, aliphatic or cycloaliphatic polyisocyanates having an NCO functionality of 2 which are known per se to the person skilled in the art.

Examples of suitable polyisocyanates of this type are 1,4-butylene diisocyanate, 1,6-hexamethylene diisocyanate (HDI), isophorone diisocyanate (IPDI), 2,2,4- and/or 2,4,4-trimethylhexamethylene diisocyanate, the isomeric bis(4,4'-isocyanatocyclohexyl)methanes or mixtures thereof with any desired isomer content, 1,4-cyclohexylene diisocyanate, 1,4-phenylene diisocyanate, 2,4- and/or 2,6-tolylene diisocyanate, 1,5-naphthylene diisocyanate, 2,2'- and/or 2,4'- and/or 4,4'-diphenylmethane diisocyanate, 1,3- and/or 1,4-bis(2-isocyanatoprop-2-yl)benzene (TMXDI), 1,3-bis(isocyanatomethyl)benzene (XDI), and alkyl 2,6-diisocyanatohexanoates (lysine diisocyanates) containing C1-C8-alkyl groups.

Besides the above-mentioned polyisocyanates, it is also possible to employ proportionately modified diisocyanates having a uretdione, isocyanurate, urethane, allophanate, biuret, imino-oxadiazinedione and/or oxadiazinetrione structure and unmodified polyisocyanates containing more than 2 NCO groups per molecule, for example 4.isocyanatomethyloctane 1,8-diisocyanate (nonane triisocyanate) or triphenylmethane 4,4',4"-triisocyanate.

These are preferably polyisocyanates or polyisocyanate mixtures of the above-mentioned type containing exclusively aliphatically and/or cycloaliphatically bonded isocyanate groups and having an average NCO functionality of the mixture of 2 to 4, preferably 2 to 2.6 and particularly preferred 2 to 2.4.

1,6-Hexamethylene diisocyanate, isophorone diisocyanate, the isomeric bis(4,4'-isocyanatocyclohexyl)methanes, and mixtures thereof, are particularly preferably employed in AA1).

Polymeric polyols having a number average molecular weight $M_n$ of 400 to 8000 g/mol, preferably 400 to 6000 g/mol and particularly preferably 600 to 3000 g/mol, are employed in AA2). These preferably have an OH functionality of 1.5 to 6, particularly preferably 1.8 to 3, very particularly preferably 1.9 to 2.1.

Polymeric polyols of this type are the polyester polyols, polyacrylate polyols, polyurethane polyols, polycarbonate polyols, polyether polyols, polyester-polyacrylate polyols, polyurethane polyacrylate polyols, polyurethane polyester polyols, polyurethane polyether polyols, polyurethane polycarbonate polyols and polyester polycarbonate polyols known per se in polyurethane coating technology. They can be employed individually or in any desired mixtures with one another in A2).

Polyester polyols of this type are the polycondensates, known per se, of di- and optionally tri- and tetraols and di- and optionally tri- and tetracarboxylic acids or hydroxycarboxylic acids or lactones. Instead of the free polycarboxylic acids, it is also possible to use the corresponding polycarboxylic anhydrides or corresponding polycarboxylates of lower alcohols for the preparation of the polyesters.

Examples of suitable dials are ethylene glycol, butylene diethylene glycol, triethylene glycol, polyalkylene glycols, such as polyethylene glycol, furthermore 1,2-propanediol, 1,3-propanediol, 1,3-butanediol, 1,4-butanediol, 1,6-hexanediol and isomers, neopentyl glycol or neopentyl glycol hydroxypivalate, where 1,6-hexanediol and isomers, neopentyl glycol and neopentyl glycol hydroxypivalate are preferred. In addition, it is also possible to employ polyols, such as trimethylolpropane, glycerol, erythritol, pentaerythritol, trimethylolbenzene or trishydroxyethyl isocyanurate.

Dicarboxylic acids which can be employed are phthalic acid, isophthalic acid, terephthalic acid, tetrahydrophthalic acid, hexahydrophthalic acid, cyclohexanedicarboxylic acid, adipic acid, azelaic acid, sebacic acid, glutaric acid, tetrachlorophthalic acid, maleic acid, fumaric acid, itaconic acid, malonic acid, suberic acid, 2-methylsuccinic acid, 3,3-diethylglutaric acid and/or 2,2-dimethylsuccinic acid. The corresponding anhydrides can also be used as acid source.

As long as the average functionality of the polyol to be esterified is >2, monocarboxylic acids, such as benzoic acid and hexanecarboxylic acid, can also be used in addition.

Preferred acids are aliphatic or aromatic acids of the above-mentioned type. Particular preference is given to adipic acid, isophthalic acid and optionally trimellitic acid.

Hydroxycarboxylic acids which can be used concomitantly as reaction participants in the preparation of a polyester polyol containing terminal hydroxyl groups are, for example, hydroxycaproic acid, hydroxybutyric acid, hydroxydecanoic acid, hydroxystearic acid and the like. Suitable lactones are caprolactone, butyrolactone and homologs. Caprolactone is preferred.

Hydroxyl-containing polycarbonates, preferably polycarbonate diols, having number average molecular weights $M_n$ of 400 to 8000 g/mol, preferably 600 to 3000 g/mol, can likewise be employed in AA2). These are obtainable by reaction of carbonic acid derivatives, such as diphenyl carbonate, dimethyl carbonate or phosgene, with polyols, preferably diols.

Examples of diols of this type are ethylene glycol, 1,2- and 1,3-propanediol, 1,3- and 1,4-butanediol, 1,6-hexanediol, 1,8-octanediol, neopentyl 1,4-bishydroxymethylcyclohexane, 2-methyl-1,3-propanediol, 2,2,4-trimethyl-1,3-pentanediol, dipropylene glycol, polypropylene glycols, dibutylene glycol, polybutylene glycols, bisphenol A and lactone-modified diets of the above-mentioned type.

The polycarbonate diol preferably comprises 40 to 100% by weight of hexanediol, preferably 1,6-hexanediol, and/or hexanediol derivatives. Hexanediol derivatives of this type are based on hexanediol and, besides terminal OH groups, contain ester or ether groups. Derivatives of this type are obtainable by reaction of hexanediol with excess caprolactone or by etherification of hexanediol with itself to give di- or trihexylene glycol.

Instead of or in addition to pure polycarbonate diols, it is also possible to employ polyether polycarbonate diols in AA2).

The hydroxyl-containing polycarbonates preferably have a linear structure.

Polyether polyols can likewise be employed in AA2).

Suitable polyether polyols are, for example, the polytetramethylene glycol polyethers known per se in polyurethane chemistry, as obtainable by polymerization of tetrahydrofuran by means of cationic ring opening.

Likewise suitable polyether polyols are the products, known per se, of the addition of styrene oxide, ethylene oxide, propylene oxide, butylene oxides and/or epichlorohydrine onto di- or polyfunctional starter molecules. Polyether polyols based on the at least proportionate addition of ethylene oxide onto di- or polyfunctional starter molecules can also be employed as component A4) (nonionic hydrophilizing agents).

Suitable starter molecules which can be employed are all compounds known from the prior art, such as, for example, water, butyl diglycol, glycerol, diethylene glycol, trimethylolpropane, propylene glycol, sorbitol, ethylenediamine, triethanolamine, 1,4-butanediol. Preferred starter molecules are water, ethylene glycol, propylene glycol, 1,4-butanediol, diethylene glycol and butyl diglycol.

Particularly preferred embodiments of the polyurethane dispersions comprise, as component AA2), a mixture of polycarbonate polyols and polytetramethylene glycol polyols, where the proportion of polycarbonate polyols in this mixture is 20 to 80% by weight and the proportion of polytetramethylene glycol polyols is 80 to 20% by weight. A proportion of 30 to 75% by weight of polytetramethylene glycol polyols and a proportion of 25 to 70% by weight of polycarbonate polyols are preferred. A proportion of 35 to 70% by weight of polytetramethylene glycol polyols and a proportion of 30 to 65% by weight of polycarbonate polyols are particularly preferred, in each case with the proviso that the sum of the percent by weight of the polycarbonate polyols and polytetramethylene glycol polyols is 100% and the proportion of the sum of the polycarbonate polyols and polytetramethylene glycol polyether polyols in component AA2) is at least 50% by weight, preferably 60% by weight and particularly preferably at least 70% by weight.

The compounds of component AA3) have molecular weights of 62 to 400 g/mol.

Polyols in the said molecular weight range having up to 20 carbon atoms, such as ethylene glycol, diethylene glycol, triethylene glycol, 1,2-propanediol, 1,3-propanediol, 1,4-butanediol, 1,3-butylene glycol, cyclohexanediol, 1,4-cyclohexanedimethanol, 1,6-hexanediol, neopentyl glycol, hydroquinone dihydroxyethyl ether, bisphenol A (2,2-bis(4-hydroxyphenyl)propane), hydrogenated bisphenol A (2,2-bis(4-hydroxyclohexyl)propane), trimethylolpropane, glycerol, pentaerythritol, and any desired mixtures thereof with one another, can be employed in AA3).

Also suitable are ester diols in the said molecular weight range, such as α-hydroxybutyl-ε-hydroxycaproic acid esters, ω-hydroxyhexyl-γ-hydroxybutyric acid esters, β-hydroxyethyl adipate or β-hydroxyethyl terephthalate.

Furthermore, monofunctional, isocyanate-reactive, hydroxyl-containing compounds can also be employed in AA3). Examples of monofunctional compounds of this type are ethanol, n-butanol, ethylene glycol monobutyl ether, diethylene glycol monomethyl ether, ethylene glycol monobutyl ether, diethylene glycol monobutyl ether, propylene glycol monomethyl ether, dipropylene glycol monomethyl ether, tripropylene glycol monomethyl ether, dipropylene glycol monopropyl ether, propylene glycol monobutyl ether, dipropylene glycol monobutyl ether, tripropylene glycol monobutyl ether, 2-ethylhexanol, 1-octanol, 1-dodecanol, 1-hexadecanol.

Preferred compounds of component AA3) are 1,6-hexanediol, 1,4-butanediol, neopentyl glycol and trimethylolpropane.

Anionically or potentially anionically hydrophilizing compounds of component AA4) are taken to mean all compounds which contain at least one isocyanate-reactive group, such as a hydroxyl group, and at least one functionality, such as, for example, $—COO^-M^+$, $—SO^{3-}M^+$, $—PO(O^-M^+)_2$, where $M^+$ is, for example, a metal cation, $H^+$, $NH_4^+$, $NHR_3^+$, where R may in each case be a C1-C12-alkyl, C5-C6-cycloalkyl and/or C2-C4-hydroxyalkyl radical, which enters into a pH-dependent dissociation equilibrium on interaction with aqueous media and may in this way be negatively charged or neutral. Suitable anionically or potentially anionically hydrophilizing compounds are mono- and dihydroxycarboxylic acids, mono- and dihydroxysulfonic acids, and mono- and dihydroxyphosphonic acids, and salts thereof. Examples of anionic or potentially anionic hydrophilizing agents of this type are dimethylolpropionic acid, dimethylolbutyric acid, hydroxypivalic acid, malic acid, citric acid, glycolic acid, lactic acid and the propoxylated adduct of 2-butenediol and $NaHSO_3$, as described in DE-A 2 446 440, pages 5-9, formulae I-III. Preferred anionic or potentially anionic hydrophilizing agents of component AA4) are those of the above-mentioned type which contain carboxylate or carboxylic acid groups and/or sulfonate groups.

Particularly preferred anionic or potentially anionic hydrophilizing agents AA4) are those which contain carboxylate or carboxylic acid groups as ionic or potentially ionic groups, such as dimethylolpropionic acid, dimethylolbutyric acid and hydroxypivalic acid, or salts thereof.

Suitable nonionically hydrophilizing compounds of component AA4) are, for example, polyoxyalkylene ethers which contain at least one hydroxyl or amino group, preferably at least one hydroxyl group.

Examples are the monohydroxyl-functional polyalkylene oxide polyether alcohols containing on statistical average 5 to 70, preferably 7 to 55 ethylene oxide units per molecule, as are accessible in a manner known per se by alkoxylation of suitable starter molecules (for example in Ullmanns Encyclopädie der technischen Chemie [Ullmann's Encyclopedia of Industrial Chemistry], 4th Edition, Volume 19, Verlag Chemie, Weinheim pp. 31-38).

These are either pure polyethylene oxide ethers or mixed polyalkylene oxide ethers, which contain at least 30 mol %, preferably at least 40 mol %, based on all alkylene oxide units present, of ethylene oxide units.

Particularly preferred nonionic compounds are monofunctional mixed polyalkylene oxide polyethers which contain 40 to 100 mol % of ethylene oxide units and 0 to 60 mol % of propylene oxide units.

Suitable starter molecules for nonionic hydrophilizing agents of this type are saturated monoalcohols, such as methanol, ethanol, n-propanol, isopropanol, n-butanol, isobutanol, sec-butanol, the isomeric pentanols, hexanols, octanols and nonanols, n-decanol, n-dodecanol, n-tetradecanol, n-hexadecanol, n-octadecanol, cyclohexanol, the isomeric methylcyclohexanols or hydroxymethylcyclohexane, 3-ethyl-3-hydroxymethylexetane or tetrahydrofurfuryl alcohol, diethylene glycol monoalkyl ethers, such as, for example, diethylene glycol monobutyl ether, unsaturated alcohols, such as allyl alcohol, 1,1-dimethylallyl alcohol or oleyl alcohol, aromatic alcohols, such as phenol, the isomeric cresols or methoxyphenols, araliphatic alcohols, such as benzyl alcohol, anisalcohol or cinnamyl alcohol, secondary monoamines, such as dimethylamine, diethylamine, dipropylamine, diisopropylamine, dibutylamine, bis(2-ethylhexyl)amine, N-methyl- and N-ethylcyclohexylamine or dicyclohexylamine, and heterocyclic secondary amines, such as morpholine, pyrrolidine, piperidine or 1H-pyrazole. Preferred starter molecules are saturated monoalcohols of the above-mentioned type. Diethylene glycol monobutyl ether or n-butanol is particularly preferably used as starter molecule.

Alkylene oxides which are suitable for the alkoxylation reaction are, in particular, ethylene oxide and propylene oxide, which can be employed in any desired sequence or also as a mixture in the alkoxylation reaction.

Di- or polyamines, such as 1,2-ethylenediamine, 1,2- and 1,3-diaminopropane, 1,4-diaminobutane, 1,6-diaminohexane, isophoronediamine, isomer mixture of 2,2,4- and 2,4,4-trimethythexamethylenediamine, 2-methylpentamethylenediamine, diethylenetriamine, triaminononane, 1,3- and 1,4-xylylenediamine, α,α,α',α'-tetramethyl-1,3- and -1,4-xylylenediamine and 4,4-diaminodicyclohexylmethane and/or dimethylethylenediamine, can be employed as component B1). It is likewise possible to use hydrazine or hydrazides, such as adipohydrazide. Preference is given to isophoronediamine, 1,2-ethylenediamine, 1,4-diaminobutane, hydrazine and diethylenetriamine.

In addition, compounds which, besides a primary amino group, also contain secondary amino groups or, besides an amino group (primary or secondary), also contain OH groups can also be employed as component BB1). Examples thereof are primary/secondary amines, such as diethanolamine, 3-amino-1-methylaminopropane, 3-amino-1-ethylaminopropane, 3-amino-1-cyclohexylaminopropane, 3-amino-1-methylaminobutane, and alkanolamines, such as N-aminoethylethanolamine, ethanolamine, 3-aminopropanol, and neopentanolamine.

Furthermore, monofunctional isocyanate-reactive amino compounds, such as, for example, methylamine, ethylamine, propylamine, butylamine, octylamine, laurylamine, stearylamine, isononyloxypropylamine, dimethylamine, diethylamine, dipropylamine, dibutylamine, N-methylaminopropylamine, diethyl(methyl)aminopropylamine, morpholine, piperidine, or suitable substituted derivatives thereof, amidoamines made from diprimary amines and monocarboxylic acids, monoketimes of diprimary amines, primary/tertiary amines, such as N,N-dimethylaminopropylamine, can also be employed as component BB1).

Preferred compounds of component BB1) are 1,2-ethylenediamine, 1,4-diaminobutane and isophoronediamine.

Anionically or potentially anionically hydrophilizing compounds of component BB2) are taken to mean all compounds which contain at least one isocyanate-reactive group, preferably an amino group, and at least one functionality, such as, for example, —$COO^-M^+$, —$SO_3^-M^+$, —$PO(O^-M^+)_2$, where $M^+$ is, for example, a metal cation, $H^+$, $NH_4^+$, $NHR_3^+$, where R may in each case be a C1-C12-alkyl radical, C5-C6-cycloalkyl radical and/or C2-C4-hydroxyalkyl radical, which enters into a pH-dependent dissociation equilibrium on interaction with aqueous media and may in this way be negatively charged or neutral.

Suitable anionically or potentially anionically hydrophilizing compounds are mono- and diaminocarboxylic acids, mono- and diaminosulfonic acids and mono- and diaminophosphonic acids, and salts thereof. Examples of anionic or potentially anionic hydrophilizing agents of this type are N-(2-aminoethyl)-β-alanine, 2-(2-aminoethylamino)-ethanesulfonic acid, ethylenediaminepropyl- or -butylsulfonic acid, 1,2- or 1,3-propylenediamine-β-ethylsulfonic acid, glycine, alanine, taurine, lysine, 3,5-diaminobenzoic acid and the product of the addition reaction of IPDA and acrylic acid (EP-A 0 916 647, Example 1). Furthermore, cyclohexylaminopropanesulfonic acid (CAPA), which is known from WO-A 01/88006, can be used as an anionic or potentially anionic hydrophilizing agent.

Preferred anionic or potentially anionic hydrophilizing agents of component BB2) are those of the above-mentioned type which contain carboxylate or carboxylic acid groups and/or sulfonate groups, such as the salts of N-(2-aminoethyl)-β-alanine, of 2-(2-aminoethylamino)ethanesulfonic acid or of the product of the addition reaction of IPDA and acrylic acid (EP-A 0 916 647, Example 1).

The hydrophilization can also be carried out using mixtures of anionic or potentially anionic hydrophilizing agents and nonionic hydrophilizing agents.

In a preferred embodiment for the preparation of the specific polyurethane dispersions, components AA1) to AA4) and BB1) to BB2) are employed in the following amounts, where the individual amounts always add up to 100% by weight:

5 to 40% by weight of component AA1), 55 to 90% by weight of AA2), 0.5 to 20% by weight of the sum of components AA3) and BB1), 0.1 to 25% by weight of the sum of components AA4) and BB2), where 0.1 to 5% by weight of anionic or potentially anionic hydrophilizing agents from AA4) and/or BB2) are used, based on the total amounts of components AA1) to AA4) and BB1) to BB2).

In a particularly preferred embodiment for the preparation of the specific polyurethane dispersions, components AA1) to AA4) and BB1) to BB2) are employed in the following amounts, where the individual amounts always add up to 100% by weight:

5 to 35% by weight of component AA1), 60 to 90% by weight of AA2), 0.5 to 15% by weight of the sum of components AA3) and BB1), 0.1 to 15% by weight of the sum of components AA4) and BB2), where 0.2 to 4% by weight of anionic or potentially anionic hydrophilizing agents from AA4) and/or BB2) are used, based on the total amounts of components AA1) to AA4) and BB1) to BB2).

In a very particularly preferred embodiment for the preparation of the specific polyurethane dispersions, components AA1) to AA4) and BB1) to BB2) are employed in the following amounts, where the individual amounts always add up to 100% by weight:

10 to 30% by weight of component AA1), 65 to 85% by weight of AA2), 0.5 to 14% by weight of the sum of components AA3) and BB1), 0.1 to 13.5% by weight of the sum of components AA4) and BB2), where 0.5 to 3.0% by weight of anionic or potentially anionic hydrophilizing agents from AA4) and/or BB2) are used, based on the total amounts of components AA1) to AA4) and BB1) BB2).

The preparation of the anionically hydrophilized polyurethane dispersions can be carried out in one or more steps in a homogeneous or multistep reaction, some in the disperse phase. After complete or partial polyaddition from AA1) to AA4), a dispersion, emulsification or dissolution step is carried out. If desired, a further polyaddition or modification in the disperse phase is subsequently carried out.

All processes known from the prior art, such as, for example, the prepolymer mixing process, acetone process or melt dispersal process, can be used here. The acetone process is preferably used.

For preparation by the acetone process, all or some of constituents AA2) to AA4) and the polyisocyanate component AA1) are usually initially introduced for the preparation of an isocyanate-functional polyurethane prepolymer and optionally diluted with a solvent which is miscible with water, but inert to isocyanate groups and heated to temperatures in the range from 50 to 120° C. In order to accelerate the isocyanate addition reaction, the catalysts known in polyurethane chemistry can be employed.

Suitable solvents are the conventional aliphatic, keto-functional solvents, such as acetone, 2-butanone, which can be added not only at the beginning of the preparation, but, if desired, can also partly be added later. Preference is given to acetone and 2-butanone.

Other solvents, such as xylene, toluene, cyclohexane, butyl acetate, methoxypropyl acetate, N-methylpyrrolidone, N-ethylpyrrolidone, solvents containing ether or ester units, may additionally be employed and distilled off in full or part or, in the case of N-methylpyrrolidone, N-ethylpyrrolidone, remain completely in the dispersion. However, other solvents apart from the conventional aliphatic, keto-functional solvents are preferably not used.

Any constituents of AA1) to AA4) which have not yet been added at the beginning of the reaction are subsequently metered in.

In the preparation of the polyurethane prepolymer from AA1) to AA4), the molar ratio of isocyanate groups to isocyanate-reactive groups is 1.05 to 3.5, preferably 1.2 to 3.0, particularly preferably 1.3 to 2.5.

The conversion of components AA1) to AA4) into the prepolymer is carried out in part or full, but preferably in full. Thus, polyurethane prepolymers which contain free isocyanate groups are obtained in the solid state or in solution.

In the neutralization step for the partial or complete conversion of potentially anionic groups into anionic, groups, bases, such as tertiary amines, for example trialkylamines having 1 to 12 C atoms, preferably 1 to 6 C atoms, particularly preferably 2 to 3 C atoms, in each alkyl radical or alkali metal bases, such as the corresponding hydroxides, are employed.

Examples thereof are trimethylamine, triethylamine, methyldiethylamine, tripropylamine, N-methylmorpholine, methyldiisopropylamine, ethyldiisopropylamine and diisopropylethylamine. The alkyl radicals may also carry, for example, hydroxyl groups, as in the case of the dialkylmonoalkanolamines, alkyldialkanolamines and trialkanolamines. Neutralizers which can be employed, if desired, are also inorganic bases, such as aqueous ammonia solution or sodium hydroxide or potassium hydroxide.

Preference is given to ammonia, triethylamine, triethanolamine, dimethylethanolamine or diisopropylethylamine, as well as sodium hydroxide and potassium hydroxide, particularly preferably sodium hydroxide and potassium hydroxide.

The molar amount of the bases is 50 to 125 mol %, preferably between 70 and 100 mol %, of the molar amount of the acid groups to be neutralized. The neutralization can also be carried out simultaneously with the dispersion if the dispersion water already comprises the neutralizer.

In a further process step, the resultant prepolymer is subsequently dissolved, if this has not already taken place or has only taken place in part, with the aid of aliphatic ketones, such as acetone or 2-butanone.

In the chain extension in step BB), $NH_2$- and/or NH-functional components are reacted in part or full with the remaining isocyanate groups of the prepolymer. The chain extension/termination is preferably carried out before the dispersion in water.

For the chain termination, amines BB1) containing an isocyanate-reactive group, such as methylamine, ethylamine, propylamine, butylamine, octylamine, laurylamine, stearylamine, isononyloxypropylamine, dimethylamine, diethylamine, dipropylamine, dibutylamine, N-methylaminopropylamine, diethyl(methyl)aminopropylamine, morpholine, piperidine, or suitable substituted derivatives thereof, amidoamines made from diprimary amines and monocarboxylic acids, monoketimes of diprimary amines, primary/tertiary amines, such as N,N-dimethylaminopropylamine, are usually used.

If the partial or complete chain extension is carried out using anionic or potentially anionic hydrophilizing agents corresponding to definition BB2) containing $NH_2$ or NH groups, the chain extension of the prepolymers is preferably carried out before the dispersion.

The aminic components BB1) and BB2) can optionally be employed in water- or solvent-diluted form in the process according to the invention, individually or in mixtures, where any sequence of addition is in principle possible.

If water or organic solvents are used concomitantly as diluents, the diluent content in the component employed in BB) for chain extension is preferably 70 to 95% by weight.

The dispersion is preferably carried out after the chain extension. To this end, the dissolved and chain-extended polyurethane polymer is either introduced into the dispersion water, optionally with high shear, such as, for example, vigorous stirring, or conversely the dispersion water is stirred into the chain-extended polyurethane polymer solutions. The water is preferably added to the dissolved chain-extended polyurethane polymer.

The solvent still present in the dispersions after the dispersion step is usually subsequently removed by distillation. Removal during the dispersion is likewise possible.

The residual content of organic solvents in the polyurethane dispersions is typically less than 1.0% by weight, based on the entire dispersion.

The pH of the polyurethane dispersions is typically less than 9.0, preferably less than 8.5, particularly preferably less than 8.0 and very particularly preferably 6.0 to 7.5.

The solids content of the polyurethane dispersions is 40 to 70% by weight, preferably 50 to 65% by weight, particularly preferably 55 to 65% by weight.

Polyacrylate polymers are prepared from monomers containing hydroxyl groups, "acidic" monomers, or monomers that contain neither acidic nor OH groups.

Suitable hydroxyl group-containing monomers include hydroxyalkyl esters of acrylic acid or methacrylic acid, preferably with 2 to 4 carbon atoms in the alkyl radical, such as 2-hydroxyethyl acrylate, 2-hydroxyethyl methacrylate, 2- or 3-hydroxypropyl acrylate and methacrylate, the isomeric hydroxybutyl acrylates and methacrylates and mixtures of these monomers.

Suitable "acidic" comonomers include olefinically unsaturated, polymerizable compounds that contain at least one carboxyl group and/or sulfonic acid group, such as olefinically unsaturated monocarboxylic or dicarboxylic acids having a molecular weight of 72 to 207. Examples include acrylic acid, methacrylic acid, maleic acid, itaconic acid and olefinically unsaturated compounds containing sulfonic acid groups, for example, 2-acrylamido-2-methylpropanesulfonic acid and mixtures of these olefinically unsaturated acids.

A third group of olefinically unsaturated monomers that may be jointly used in the production of polyacrylate polymers include olefinically unsaturated compounds that do not contain either acidic groups or hydroxyl groups. Examples include esters of acrylic acid or methacrylic acid with 1 to 18, preferably 1 to 8 carbon atoms in the alcohol radical, such as methyl acrylate, ethyl acrylate, isopropyl acrylate, n-propyl acrylate, n-butyl acrylate, 2-ethylhexyl acrylate, isobornyl acrylate, n-stearyl acrylate, the methacrylates corresponding to these acrylates, styrene, alkyl-substituted styrenes, butadiene, isoprene, acrylonitrile, methacrylonitrile, vinyl acetate, vinyl stearate, and mixtures of these monomers. Comonomers containing epoxy groups, such as glycidyl acrylate or methacrylate, or monomers, such as N-methoxymeth-acrylamide or N-methacrylamide, may also be used in minor amounts.

The production of aqueous dispersions containing polyacrylate and/or polybutadiene is carried out according to known free-radical polymerization methods, for example, solution polymerization, emulsion polymerization and suspension polymerization. The process of free-radical emulsion polymerization in an aqueous medium is preferred.

Continuous or discontinuous polymerization processes may be used. Examples of discontinuous processes are the batch process and feed process, the latter being preferred. In the feed process water is added alone or with part of the anionic emulsifier and optionally a non-ionic emulsifier, as well as with part of the monomer mixture, and is heated to the polymerization temperature. In the case of a monomer addition the polymerization is started by free radicals and the remaining monomer mixture is metered in together with an initiator mixture and the emulsifier over a period of 1 to 10 hours, preferably 3 to 6 hours. If necessary, the reaction mixture is then post-activated in order to carry out the polymerization to a conversion of at least 99%.

The emulsifiers used are may be anionic and/or non-ionic. Anionic emulsifiers are those containing carboxylate, sulfate, sulfonate, phosphate or phosphonate groups. Emulsifiers are preferred that contain sulfate, sulfonate, phosphate or phosphonate groups. The emulsifiers may have a low molecular weight or high molecular weight. The latter are described, for example, in DE-A 3 806 066 and DE-A 1 953 349.

Preferred anionic emulsifiers are those that are built up from long-chain alcohols or substituted phenols and a polyether chain bonded to the hydroxyl group containing 2 to 100 ethylene oxide units as well as a sulfuric acid or phosphoric acid group bonded in the form of an ester unit. Ammonia or amines are preferred neutralizing agents for the unesterified acid groups. The emulsifiers may be added to the emulsion batch individually or as mixtures.

Suitable as non-ionic emulsifiers, which may be used in combination with the anionic emulsifiers, are reaction products of aliphatic, araliphatic, cycloaliphatic or aromatic carboxylic acids, alcohols, phenol derivatives and/or amines with epoxides, such as ethylene oxide. Examples include reaction products of ethylene oxide with castor oil carboxylic acids and abietic acid; with long-chain alcohols such as oleyl alcohol, lauryl alcohol, stearyl alcohol; with phenol derivatives such as substituted benzyl phenols, phenyl phenols and nonyl phenols; and with long-chain amines such as dodecylamine and stearylamine. The reaction products with ethylene oxide include oligoethers and/or polyethers with degrees of polymerization of 2 to 100, preferably 5 to 50.

These emulsifiers are added in amounts of 0.1 to 10 wt. %, based on the mixture of the monomers. Suitable co-solvents include water-soluble as well as water-insoluble solvents. Suitable co-solvents include aromatic compounds such as benzene, toluene, xylene and chlorobenzene; esters such as ethyl acetate, butyl acetate, methyl glycol acetate, ethyl glycol acetate and methoxypropyl acetate; ethers such as butyl glycol, tetrahydrofuran, dioxane, ethyl glycol ether and ethers of diglycol; ketones such as acetone, methyl ethyl ketone, methyl isobutyl ketone; trichloromonofluoroethane; and cyclic amides such as N-methyl-pyrrolidone and N-methylcaprolactam.

The free radical-initiated polymerization may be started by water-soluble and water-insoluble initiators or initiator systems whose radical decomposition half-lives at temperatures from 10° C. to 100° C. are 0.5 sec. to 7 hours.

In general the polymerization is carried out in aqueous emulsion in the aforementioned temperature range, preferably between 30° C. and 90° C., under a pressure of $10^3$ to $2\times10^4$ mbar. The exact polymerization temperature is determined according to the type of initiator. The initiators are used in amounts of 0.05 to 6 wt. %, based on the total amount of monomers.

Suitable initiators include water-soluble and water-insoluble azo compounds such as azoisobutyrodinitrile or 4,4'-azo-bis-(4-cyanopentanoic acid); inorganic and organic peroxides such as dibenzoyl peroxide, t-butyl perpivalate, t-butyl-per-2-ethylhexanoate, t-butyl perbenzoate, t-butyl hydroperoxide, di-t-butyl peroxide, cumene hydroperoxide, dicyclohexyl dicarbonate, dibenzyl peroxydicarbonate, the sodium, potassium and ammonium salts of peroxodisulfuric acid, and hydrogen peroxide. The peroxodisulfates and hydrogen peroxides may be used in combination with reducing agents, such as the sodium salt of formamidinesulfinic acid, ascorbic acid or polyalkylene polyamines. A significant reduction of the polymerization temperature is generally thereby achieved.

In order to regulate the molecular weight of the polymers conventional regulators may be used, such as n-dodecylmercaptan, t-dodecylmercaptan, diisopropyl xanthogene disulfide, di(methylene-trimethylolpropane)xanthogene disulfide and thioglycol. The regulators are added in amounts of at most 3 wt. %, based on the monomer mixture.

If necessary after the end of the polymerization reaction, neutralizing agents are added to the polymers present in aqueous dispersion to obtain a degree of neutralization of 30 to 100%, preferably 50 to 100%. Inorganic bases, ammonia or amines are added as neutralizing agents. Examples include inorganic bases, such as sodium hydroxide and potassium hydroxide; and amines such as ammonia, trimethylamine, triethylamine, dimethylethanolamine, methyldiethanolamine and triethanolamine. The neutralizing agents may be used in substoichiometric or excess stoichiometric amounts, which results in the aforementioned contents of sulfonate and/or carboxylate groups, in particular carboxylate groups and the aforementioned acid numbers.

When there is complete neutralization of the acidic groups that may optionally be present, the result is an acid number of zero, such that the content of sulfonate and/or carboxylate groups corresponds to the original content of sulfonic acid groups and/or carboxyl groups. With partial neutralization the content of sulfonate and/or carboxylate groups corresponds to the amount of neutralizing agent that is employed. The resulting aqueous dispersions have the aforementioned concentrations and viscosities. The optional co-solvents may remain in the aforementioned amounts in the aqueous dispersion or may be removed by distillation after the polymerization reaction.

Preferred aqueous dispersions B comprising polyacrylates are dispersions sold under the brand name Primal® which are available from Rohm and Hass, Philadelphia, Pa., USA. Preferred aqueous dispersions B comprising polybutadiene include Euderm®-Resin40B and Euderm®-Resin50B.

The dispersion B may additionally comprise coagulants besides anionically hydrophilized polyurethane.

Said coagulants which can be employed in the are all organic compounds containing at least 2 cationic groups, preferably all known cationic flocculants and precipitants from the prior art, such as cationic homopolymers or copolymers of salts of poly[2-(N,N,N-trimethylamino)ethyl acrylate], of polyethyleneimine, of poly[N-(dimethylaminomethyl)acrylamide], of substituted acrylamides, of substituted methacrylamides, of N-vinylformamide, of N-vinylacetamide, of N-vinylimidazole, of 2-vinylpyridine or of 4-vinylpyridine.

Preferred additional coagulants are cationic copolymers of acrylamide which contain structural units of the general formula (2), particularly preferably cationic copolymers of acrylamide which contain structural units of the formula (1) and those of the general formula (2):

formula (1)

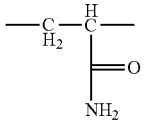

formula (2)

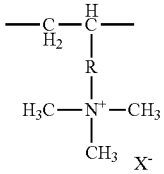

where

R is C═O, —COO$(CH_2)_2$— or —COO$(CH_2)_3$— and $X^-$ is a halide ion, preferably chloride.

The cationic coagulant employed is particularly preferably a polymer of this type having a number average molecular weight of 500,000 to 50,000,000 g/mol.

Coagulants of this type are marketed, for example, under the trade name Praestol® (Degussa Stockhausen, Krefeld, Del.) as flocculants for sewage sludges. Preferred coagulants of the Praestol® type are Praestol® K111L, K122L, K133L, BC 270L, K 144L, K 166L, BC 55L, 185K, 187K, 190K, K222L, K232L, K233L, K234L, K255L, K332L, K 333L, K 334L, E 125, E 150, and mixtures thereof. Very particularly preferred coagulants are Praestol® 185K, 187K and 190K, and mixtures thereof.

Dispersion B preferably comprises at least one pigment.

The present invention will be further described with reference to further embodiments and different aspects. They may be combined freely unless the context clearly indicates otherwise.

In one embodiment of the process according to the invention the salt of dispersion A is selected from the group consisting of tertiary ammonium salts, quaternary ammonium salts, tertiary phosphonium salts and quaternary phosphonium salts. In this respect, the tertiary salts are to be understood as tertiary amines or phosphines which have been protonated.

In another embodiment of the process according to the invention the salt of dispersion A is selected from the group consisting of (chloro-hydroxyalkyl)trialkylammonium salts, trialkyl[(trialkoxysilyl)alkyl]ammonium salts, trialkylalkoxyl ammonium salts, trialkylammonium epihydrinamine salts, monoammonium salts of N,N,N',N'-tetrakis(2-hydroxyalkyl)alkylenediamine and diammonium salts of N,N,N',N'-tetrakis(2-hydroxyalkyl)alkylenediamine.

The aforementioned alkyl can preferably contain 1-10 carbon atoms in the alkyl part and can be unsubstituted or substituted with optionally 1, 2, 3, 4, 5, 6, 7, 8 or 9 substituents selected independently of one another from the group consisting of F, Cl, Br, I, —CN, —$NO_2$, —OH, —$NH_2$, —SH, —O($C_{1-5}$-alkyl), —S($C_{1-5}$-alkyl), —NH($C_{1-5}$-alkyl), —N($C_{1-5}$-alkyl) ($C_{1-5}$-alkyl), $OCF_3$, $C_{3-8}$-cycloalkyl and —$SCF_3$.

Preferred are alkyl groups selected from the group consisting of methyl, ethyl, n-propyl, isopropyl, n-butyl, sec-butyl, isobutyl, tert-butyl, n-pentyl, sec-pentyl, neopentyl and n-hexyl, which can optionally be substituted with 1, 2, 3, 4, 5, 6, 7, 8 or 9 substituents selected independently of one another from the group consisting of F, Cl, Br, I, —CN, —$NO_2$, —OH, —$NH_2$, —SH, —$OCH_3$, —O—$C_2H_5$, —$SCH_3$, —S—$C_2H_5$, —$OCF_3$, —$SCF_3$, —NH—$CH_3$, —N($CH_3$)$_2$, —N($C_2H_5$)$_2$ and —N($CH_3$)($C_2H_5$). More preferred are unsubstituted alkyl groups selected from the group consisting of methyl, ethyl, n-propyl, isopropyl, n-butyl, sec-butyl, isobutyl, tert-butyl, n-pentyl, sec-pentyl, neopentyl and n-hexyl.

Trialkylammonium epihydrinamine salts can alternatively be named trialkylammonium salts of oxiranemethaneamine, whereby oxiranemethaneamine has the following structure:

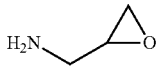

More preferably, the salt of dispersion A is selected from the group consisting of (3-chloro-2-hydroxypropyl)trimethylammonium chloride (CHPTAC), dimethyloctadecyl[3-(trimethoxysilyl)propyl]ammonium chloride, dimethyl octadecyl hydroxyethyl ammonium nitrate, N,N,N-trimethylammonium epihydrineamine salts, N,N,N-triethylammonium epihydrineammonium salts, monoammonium salts of N,N,N',N'-tetrakis(2-hydroxypentyl)ethylenediamine and diammonium salts of N,N,N',N'-tetrakis(2-hydroxypentyl)ethylenediamine.

In another embodiment of the process according to the invention the organic onium salt is present in dispersion A in an amount of ≥0.01% by weight to ≤15% by weight, based on the total amount of dispersion A. Preferred amounts are ≥0.5% by weight to ≤10% by weight and more preferred ≥0.5% by weight to ≤8% by weight, based on the total amount of dispersion A.

In another embodiment of the process according to the invention the modified cellulose is a compound selected from the group consisting of methylcellulose, ethylcellulose, propylcellulose, hydroxymethylcellulose, hydroxyethylcellulose, hydroxypropylcellulose, hydroxypropylmethylcellulose, carboxymethylcellulose, carboxyethylcellulose and carboxypropylcellulose. Particularly preferred are methylcellulose or ethyl cellulose.

In another embodiment of the process according to the invention the modified cellulose is present in dispersion A in an amount of ≥10 ppm by weight to ≤25% by weight, based on the total amount of dispersion A. Preferred is an amount of 100 ppm to 10% by weight, particularly preferred an amount of 100 ppm to 3% by weight, based on the total amount of dispersion A.

In another embodiment of the process according to the invention the textile substrate employed is a woven fabric, knitted fabric or nonwoven based on natural and/or synthetic fibers. The textile substrate is particularly preferably a nonwoven (staple fiber nonwoven, microfiber nonwoven or the like).

In another embodiment of the process according to the invention the polyurethane is precipitated in step c) in a bath containing water and/or by heating to a temperature in the range from ≥80° C. to ≤180° C. A preferred temperature range is ≥80° C. to ≤120° C.

In another embodiment of the process according to the invention the process further comprises the step of at least partially removing excess liquids after step a) and/or after step b). After being brought into contact with a dispersion A, the textile substrate is preferably passed through a wringer device comprising two rollers in order to remove the excess dispersion A. The wringer device here should preferably be set in such a way that dispersion A remains in the textile substrate in an amount of 60 to 180% by weight, particularly preferably 70 to 140%, very particularly preferably 80 to 120%, based on the weight per unit area of the substrate (liquid uptake), before the substrate is brought into contact with the dispersion B containing polyurethane. The textile substrate is preferably partially dried for a period of 2 to 10 minutes, particularly preferably 1 to 5 minutes, using air, infrared or hot cylinders before it is brought into contact with the dispersion B containing polyurethane.

Another aspect of the present invention is a coated textile obtainable by a process according to the present invention. In one embodiment the coated textile is synthetic leather.

Another aspect of the present invention is the use of organic onium salts of one or more elements of the fifth main group of the periodic table of the elements for the production of coated textiles.

In one embodiment of the use according to the invention the organic onium salt is selected from the group consisting of tertiary ammonium salts, quaternary ammonium salts, tertiary phosphonium salts and quaternary phosphonium salts. In this respect, the tertiary salts are to be understood as tertiary amines or phosphines which have been protonated.

In another embodiment of the use according to the invention the organic onium salt is selected from the group consisting of (chloro-hydroxyalkyl)trialkylammonium salts, trialkyl[(trialkoxysilyl)alkyl]ammonium salts, trialkylalkoxyl ammonium salts, trialkylammonium epihydrinamine salts, monoammonium salts of N,N,N',N'-tetrakis(2-hydroxyalkyl)alkylenediamine and diammonium salts of N,N,N',N'-tetrakis(2-hydroxyalkyl)alkylenediamine. Preferred salts of these types are (3-chloro-2-hydroxypropyl)trimethylammonium chloride (CHPTAC), dimethyloctadecyl[3-(trimethoxysilyl)propyl]ammonium chloride, dimethyl octadecyl hydroxyethyl ammonium nitrate, N,N,N-trimethylammonium epihydrineamine salts, N,N,N-triethylammonium epihydrineammonium salts, monoammonium salts of N,N,N',N'-tetrakis(2-hydroxypentyl)ethylenediamine and diammonium salts of N,N,N',N'-tetrakis(2-hydroxypentyl)ethylenediamine.

The aforementioned alkyl can preferably contain 1-10 carbon atoms in the alkyl part and can be unsubstituted or substituted with optionally 1, 2, 3, 4, 5, 6, 7, 8 or 9 substituents selected independently of one another from the group consisting of F, Cl, Br, I, —CN, —$NO_2$, —OH, —$NH_2$, —SH, —O($C_{1-5}$-alkyl), —S($C_{1-5}$-alkyl), —NH($C_{1-5}$-alkyl), —N($C_{1-5}$-alkyl), $OCF_3$, $C_{3-8}$-cycloalkyl and —$SCF_3$.

Preferred are alkyl groups selected from the group consisting of methyl, ethyl, n-propyl, isopropyl, n-butyl, sec-butyl, isobutyl, tert-butyl, n-pentyl, sec-pentyl, neopentyl and n-hexyl, which can optionally be substituted with 1, 2, 3, 4, 5, 6, 7, 8 or 9 substituents selected independently of one another from the group consisting of F, Cl, Br, I, —CN, —$NO_2$, —OH, —$NH_2$, —SH, —$OCH_3$, —O—$C_2H_5$, —$SCH_3$, —S—$C_2H_5$, —$OCF_3$, —$SCF_3$, —NH—$CH_3$, —N$(CH_3)_2$, —N$(C_2H_5)_2$ and —N$(CH_3)(C_2H_5)$. More preferred are unsubstituted alkyl groups selected from the group consisting of methyl, ethyl, n-propyl, isopropyl, n-butyl, sec-butyl, isobutyl, tert-butyl, n-pentyl, sec-pentyl, neopentyl and n-hexyl, In another embodiment of the use according to the invention the coated textile is synthetic leather.

The present invention will now be described with reference to the following examples without wishing to be limited by them.

EXAMPLES

| | |
|---|---|
| antistatic agent SN | contains N,N,N',N'-tetrakis(2-hydroxypentyl)ethylene diamine, supplied by Jiangshu Haihua Trading Company |
| methyl-hydroxyethyl cellulose | supplied by Wolff Cellulosics GmbH & Co. KG, Germany |
| Impranil® LP DSB 1069 | aqueous polyurethane dispersion supplied by Bayer MaterialScience AG, Germany |
| Coagulant WS | supplied by Lanxess GmbH, Germany |
| Emulvin WA | supplied by Lanxess GmbH, Germany |

Dispersion A has the following composition:

| | |
|---|---|
| antistatic agent SN | 80 pbw |
| methylhydroxyethyl cellulose | 1 pbw |
| Water | 919 pbw |

Dispersion A has a viscosity of 400 to 500 cps determined by using Brookfield Viscometer DV-II+ PRO.

Dispersion B has the following composition:

| | |
|---|---|
| Impranil® LP DSB 1069 | 1000 pbw |
| Coagulant WS | 20 pbw |
| Emulvin WA | 20 pbw |

Dispersion B has a viscosity of 300 to 400 cps determined by using Brookfield Viscometer DV-II+ PRO.

The textile substrate was dipped into dispersion A for 10 seconds, padded with at 4 bar and dried at 100° C., for a period of 1 to 2 minutes. Subsequently, the textile substrate was dipped into dispersion B for a period of 10 to 15 seconds and padded with at 4 bar. The substrate was treated three times each treatment lasting 3 minutes with air at 80° C. and low speed. Finally, the substrate was soft tumbled.

Substrates which have been subjected to the above described process without dipping into dispersion A had a very hard and stiff feel.

By contrast, substrates which were treated in accordance with the invention as described above exhibited a pleasantly soft, round feel. On subsequent coating of the resultant substrates, considerable differences were likewise apparent between the substrates treated with dispersions A and B and the substrates which were only treated with dispersion B, such that the fall of the folds (folding) appeared sharp and/or blistered in the case of the untreated substrate. The substrate treated in accordance with the invention exhibited round, optically perfect folding.

The invention claimed is:

1. A process for the production of a coated textile, comprising at least the steps of a) first, bringing a textile substrate into contact with an aqueous dispersion A consisting essentially of at least one salt and at least one modified cellulose, b) subsequently, bringing a textile substrate into contact with an aqueous dispersion B comprising at least one polymer selected from the group consisting of polyurethane, polyacrylate and polybutadiene, and c) precipitating the polyurethane in or on the textile substrate, wherein the salt of dispersion A is an organic onium salt of one or more elements of the fifth main group of the periodic table of the elements.

2. The process according to claim 1, wherein the salt of dispersion A is selected from the group consisting of tertiary ammonium salts, quaternary ammonium salts, tertiary phosphonium salts and quaternary phosphonium salts.

3. The process according to claim 1, wherein the salt of dispersion A is selected from the group consisting of (chloro-hydroxyalkyl)trialkylammonium salts, trialkyl[(trialkoxysilyl)alkyl]ammonium salts, trialkylalkoxyl ammonium salts, trialkylammonium epihydrinamine salts, monoammonium salts of N,N,N',N'-tetrakis(2-hydroxyalkyl) alkylenediamine and diammonium salts of N,N,N',N'-tetrakis(2-hydroxyalkyl)alkylenediamine.

4. The process according to claim 1, wherein the organic onium salt is present in dispersion A in an amount of ≥0.01% by weight to ≤15% by weight, based on the total amount of dispersion A.

5. The process according to claim 1, wherein the modified cellulose is a compound selected from the group consisting of methylcellulose, ethylcellulose, propylcellulose, hydroxymethylcellulose, hydroxyethylcellulose, hydroxypropylcellulose, hydroxypropylmethylcellulose, carboxymethylcellulose, carboxyethylcellulose and carboxypropylcellulose.

6. The process according to claim 1, wherein the modified cellulose is present in dispersion A in an amount of ≥10 ppm by weight to ≤25% by weight, based on the total amount of dispersion A.

7. The process according to claim 1, wherein the textile substrate is a woven fabric, knitted fabric or nonwoven based on natural and/or synthetic fibers.

8. The process according to claim 1, wherein the polyurethane is precipitated in step c) in a bath containing water and/or by heating to a temperature in the range from ≥80° C. to ≤180° C.

9. The process according to claim 1, further comprising the step of at least partially removing excess liquids after step a) and/or after step b).

10. A process for the production of a coated textile, consisting of the steps of a) first, bringing a textile substrate into contact with an aqueous dispersion A essentially consisting of at least one salt and at least one modified cellulose, wherein the salt is selected from the group consisting of (chlorohydroxyalkyl)trialkylammonium salts, trialkyl[(trialkoxysilyl)alkyl]ammonium salts, trialkylalkoxyl ammonium salts, trialkylammonium epihydrinamine salts, monoammonium salts of N,N,N',N'-tetrakis(2-hydroxyalkyl)alkylenediamine and diammonium salts of N,N,N',N-tetrakis(2-hydroxyalkyl)alkylenediamine, a1) partially removing excess liquids, b) subsequently, bringing a textile substrate into contact with an aqueous dispersion B comprising at least one polymer selected from the group consisting of polyurethane, polyacrylate and polybutadiene, b1) partially removing excess liquids, and c) precipitating the polyurethane in or on the textile substrate.

* * * * *